US006071044A

United States Patent [19]

Ricciardelli et al.

[11] Patent Number: 6,071,044

[45] Date of Patent: Jun. 6, 2000

[54] MODULAR LANDSCAPING STRUCTURE

[75] Inventors: Thomas E. Ricciardelli, Hingham, Mass.; Jerry M. Presson, Trumbull, Conn.

[73] Assignee: Selectech, Inc., Taunton, Mass.

[21] Appl. No.: 09/044,068

[22] Filed: Mar. 16, 1998

[51] Int. Cl.[7] ..... E02D 3/02

[52] U.S. Cl. ..... 405/286; 52/233; 405/258; 405/284

[58] Field of Search ..... 405/284, 286, 405/262, 258, 272, 273; 52/233

[56] References Cited

U.S. PATENT DOCUMENTS

| | | | |
|---|---|---|---|
| 2,687,033 | 8/1954 | Snyder | 52/233 |
| 4,503,648 | 3/1985 | Mahaffey | 52/233 X |
| 4,522,006 | 6/1985 | Plikuhn | 52/233 X |
| 4,688,362 | 8/1987 | Pedersen et al. | 52/233 X |
| 4,834,585 | 5/1989 | Hasenwinkle et al. | 405/286 |
| 4,897,955 | 2/1990 | Winsor | 52/233 X |
| 5,037,243 | 8/1991 | Dice | 405/262 |
| 5,163,259 | 11/1992 | Hunsaker et al. | 52/233 |
| 5,542,787 | 8/1996 | Charlanow | 405/284 X |
| 5,675,930 | 10/1997 | Cooper | 52/233 X |
| 5,806,249 | 9/1998 | Helms | 52/233 X |

OTHER PUBLICATIONS

Three photographs of SelecTech traffic control products; pre–1998.

Three photographs of SelecTech parking stops; pre–1998.

One page of SelecTech literature showing SelecTech traffic control products; pre–1998.

One page of SelecTech literature showing SelecTech parking stops; pre–1998.

*Primary Examiner*—Dennis L. Taylor

*Attorney, Agent, or Firm*—Jerry M. Presson

[57] ABSTRACT

A polymeric landscaping structure, for uses such as retaining walls and landscape edging, that may be co-aligned without an exposed end. The structure has a U-shaped exterior with exterior end walls. The U-shaped exterior forms a cavity in which an interior wall is disposed such that when the structure is cut to a predetermined length, the interior wall will be exposed and form an exterior end wall. The structure has premolded bores which can be co-aligned for various lengths of structures required for multi-structure installations.

38 Claims, 4 Drawing Sheets

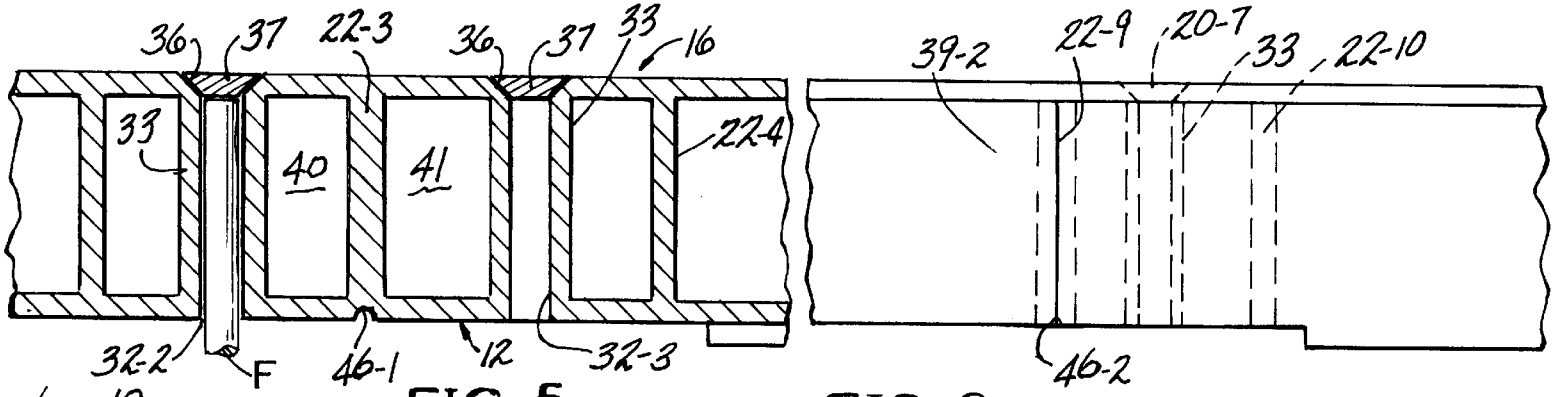
FIG-8
FIG-5
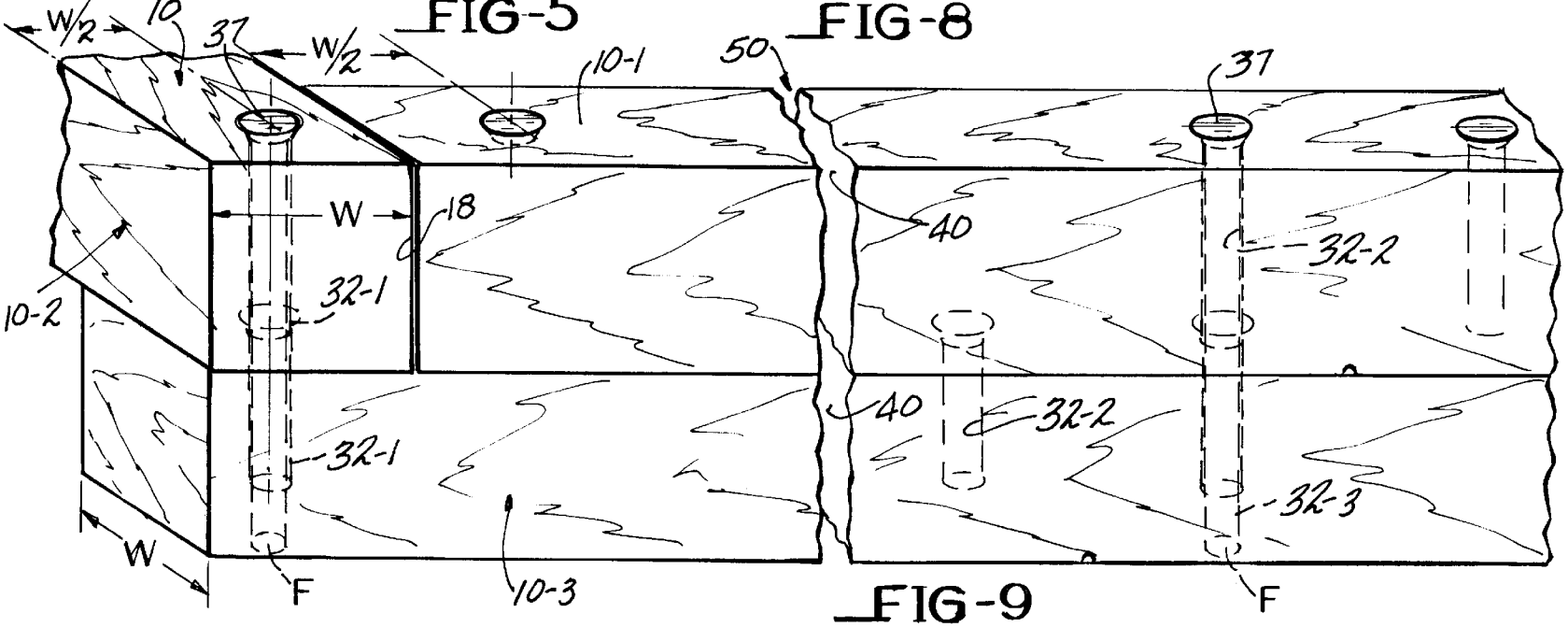
FIG-9

MODULAR LANDSCAPING STRUCTURE

FIELD OF INVENTION

This invention relates to a plastic modular landscaping structure simulating a natural wood timber in appearance and more particularly, to a new and improved plastic module for ready installation as an artificial landscaping timber.

BACKGROUND OF THE INVENTION

Prior art plastic modular timber-like structures are elongated and of rectangular cross-section to resemble natural wood landscaping timbers.

To install a retaining wall employing either plastic or wood types of landscape modules, the modules are placed one on top of the other by the installer until a vertical stack of the desired height is assembled. The modules are secured one to the other by fasteners, such as bolts, nails or spikes driven through the upper module into an immediately adjacent lower module positioned directly under the upper module. Plastic modules are typically formed with through-bores at spaced apart intervals along the module during the manufacture thereof, so that the bores are embodied in the modules as they are received at the site of installation and through which appropriate fasteners may be driven.

So long as any two superimposed modules are installed in the same lengths as they are manufactured with their butt ends in flush relationship; the bores of the two vertically stacked modules will be oriented in vertical co-alignment to receive a fastener driven into both bores. However, in the event one or more of the superimposed modules is shortened, the possibility that the bores will be vertical co-alignment becomes problematic and increases as the stack height increases.

Importantly, to enhance the structural integrity of a retaining wall, the modules are assembled in a multilayered stack wherein a separation or joint is created between horizontally opposing ends of the two end-abutting modules. With the modules assembled in a vertically staggered relationship, the opposing butt ends of two modules in one layer are secured together by another axially disposed module placed in an overlying or underlying relationship and spanning the butt joint. While staggering increases stack rigidity, it requires the installer to cut off a section of the module, which oftentimes results in vertical misalignment of the bores for receiving fasteners. Additionally, the installer may deploy a stack stabilizing module or so-called "dead man" which is a short section of the module laid at right angles to the vertical plane of the stack. One end of the dead-man is embedded in the soil behind the stack and the frontward end is positioned flush with the frontal surface of the stack and thereafter fastened to the upper surface of the wall module that the dead-man lays upon. Both installations require that transverse cuts be made through the module thereby altering the otherwise predetermined axial distances between one end of the module and the preformed bores.

These different assemblages therefore add difficulty to the problem of pre-positioning the bore holes in a plastic modular structure during manufacture to insure proper horizontal or vertical co-alignment with other preformed bores of other modules at the point of assembly. Advantageously, if such alignment were achievable the installer could use rebars as fasteners to hold a multiple module stacked assemblage together and to anchor the stack to the underlying strata.

Therefore, it would be an important advantage in the design of plastic timbers to be able to provide a pattern of preformed bore holes in the module which may be readily co-aligned with corresponding bore holes in other modules during the aforedescribed installations whether the module is used in its original manufactured length or is shortened to achieve, for example, a staggering between the modules or dead-man deployment.

Plastic landscaping timbers are typically made with solid cores. When the installer severs a solid cored module at right angles to its longitudinal axis to shorten the module, for example, the new butt end thusly created is similar in appearance to the original butt end. Therefore, the shortened module can be used practically everywhere throughout the stack without adversely affecting its aesthetic appearance. In this respect, the solid cored plastic module closely resembles its wood counterpart.

Solid core plastic modules require considerably more polymeric material to fabricate than modules that are wholly or partially hollow, and hence, hollow modules are desirable for their lighter weight and lower cost. However, a hollow module suffers a significant disadvantage in that the cross-section thereof is cavitated or partially hollow throughout and, therefore, a cross sectioned cut made through the module to, for example, shorten its length or to create a right angled butt end, results in a severed butt end which is hollow or otherwise cavitated but not completely solid throughout when viewed from that end. Therefore, it would be an important advantage to provide a module that does not have a completely solid core and yet can provide a solid end wall after being severed to reduce its length so that the butt end of the shortened module still closely resembles those of the original module from which it was severed.

SUMMARY OF THE INVENTION

According to this invention there is provided an elongated modular structure composed of three side walls; two parallel and one transverse adjoining one another to form a cavitated structure of U-shaped cross section, with opposite enclosed end walls and one open side opposite the transverse side wall. Inside the structure are a plurality of elongated mounting elements depending perpendicularly vertically from the transverse side wall and spaced apart at predetermined locations along the longitudinal axis of the module. Each element is enclosed and fixedly supported within an interior walled compartment and contains an open-ended bore, the open end facing the open side of the module.

Each mounting compartment is bounded by at least one solid interior end wall facing opposite different exterior end walls and extending parallel thereto so as to serve as an alternative end wall when the module is shortened by cutting parallel to the face of a selected interior wall through or flush with the selected wall. The bore is located a predetermined distance from the interior end wall of its compartment and may extend completely through the module or may bottom to leave a covering between the bore bottom and the outer surface of the module. In either case, each bore is designed to receive and guide a fastening means inserted into the transverse side wall opposite a corresponding one of the bores. The mounting elements are positioned relative to the side walls and the interior and exterior end walls of the module such that a bore of one module may be co-aligned with the bore of the mounting element of another superimposed module which may be of considerably different length and orientation to provide element-to-element attachment by a single, common fastening means.

BRIEF DESCRIPTION OF THE DRAWINGS

FIG. 5 is a sectional side view of the module taken along section lines 5—5 of FIG. 1 and shows a fastener inserted into the module.

FIG. 8 is a side elevation of the instant module showing typical cutting lines opposite certain interior walls of the module.

FIG. 9 is a front isometric elevational view illustrating the front side of one possible embodiment of a typical modular wall constructed of vertically stacked assemblage of combinations of modules of this invention and fastened together.

DETAILED DESCRIPTION OF THE INVENTION

Figure 1:
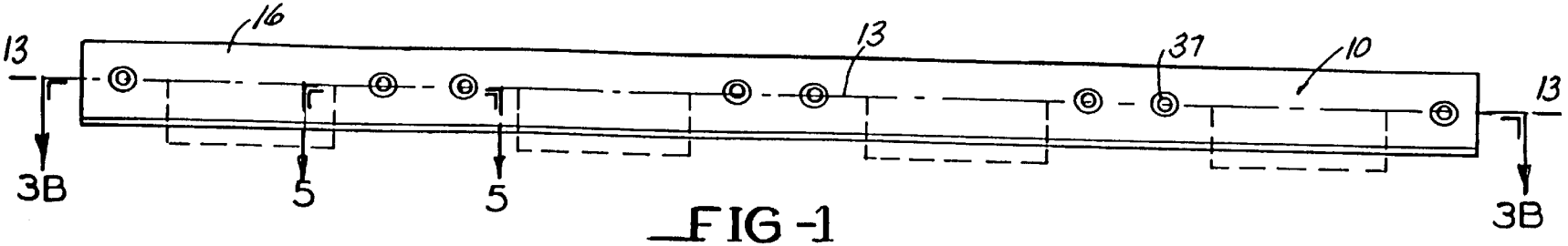
FIG. 1 is a top plan view of one embodiment of a module constructed in accordance with this invention.
Figure 2:
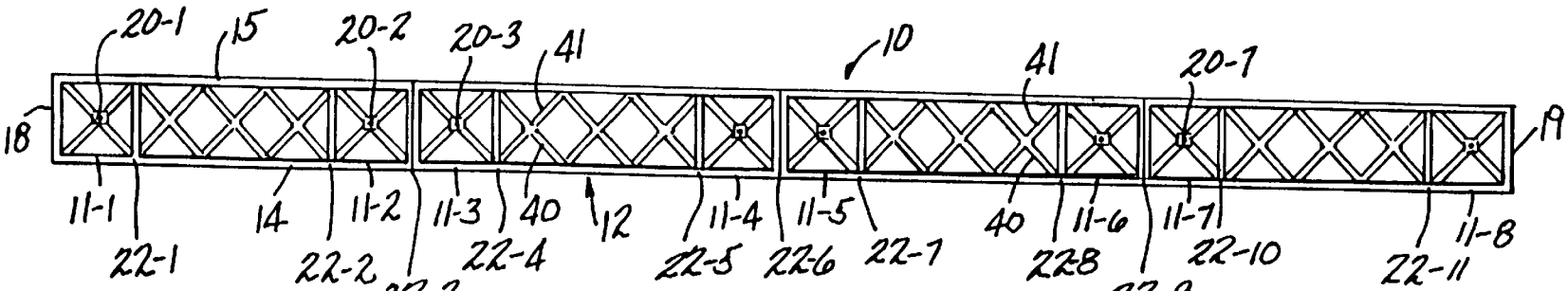
FIG. 2 is a bottom plan view of the module illustrated in FIG. 1.

With reference to FIGS. 1 and 2, module 10 comprised of polymeric material is a unitary, substantially hollow structure formed by molding a polymeric granular material such as a thermoplastic polymer or copolymer in an injection-molding machine. Polymeric materials in granular form obtained from recycled thermoplastic articles may be used to minimize costs, and if desired, strengthening agents such as glass or other fibers may be intermixed with the granules prior to molding to provide greater rigidity and strength to the structure.

Figure 3B:
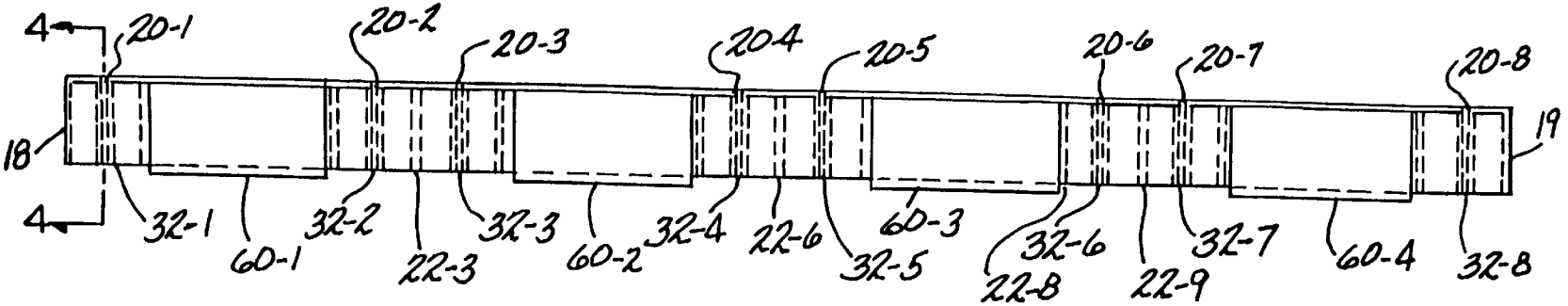
FIG. 3B is a view of the rearward side of the module of this invention taken along section lines 3B—3B of FIG. 1.
Figure 3A:
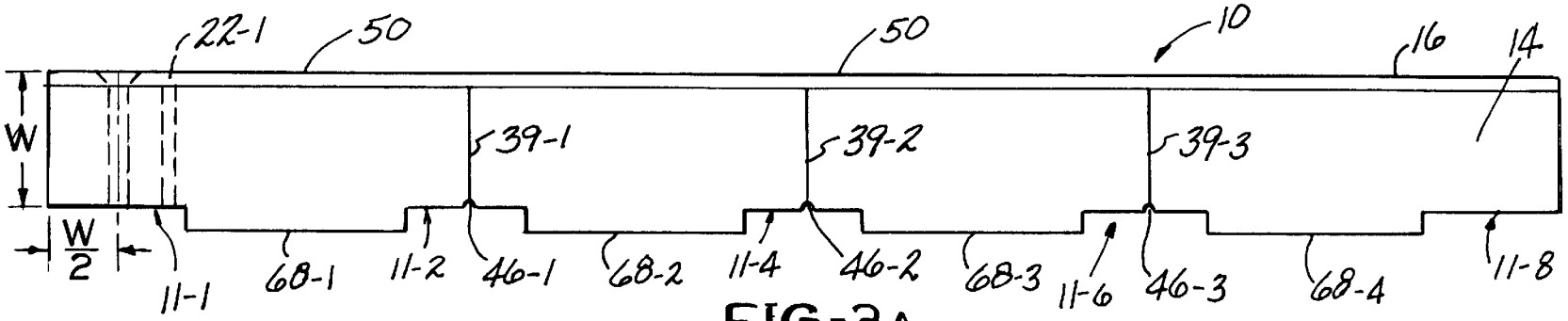
FIG. 3A is side elevation end view of the rearward side of the module of this invention.

As seen in FIGS. 1, 2 and 3A, module 10 is constructed compartments 11, typically eight in number, and individually designed as 11-1 . . . 11-8, an open bottom side 12, and a central longitudinal axis 13 midway the width of the module 10. Because it is partially hollow throughout, module 10 has the advantages mentioned hereinabove of economy and lightness.

Two coextensive, mutually parallel side walls 14 and 15, as shown in FIG. 2, of rectangular shape and cross-section and of length L are aligned in parallel planes symmetrically with respect to the central axis 13 midway therebetween. A third side wall 16, as shown in FIG. 1, of rectangular shape and cross section and of length of L is joined at its edges transversely to the edges of each side wall 14 and 15, is molded integral with the side walls, and forms what typically becomes the top wall of the module 10 during installation. Two opposite exterior end walls 18 and 19, respectively, of rectangular shape and cross-section complete the enclosure of the module 10 by joining opposite edges of the side walls. The open side 12 typically becomes the bottom of the module which, for example, may be laid upon the top wall of another module of essentially identical construction or directly upon underlying soil or strata, depending on the particular landscape installation, exemplary installations being shown in FIGS. 9–12, respectively. The three-sided solid enclosure of module 10 may be made to simulate natural wood by molding irregularities resembling a hewn surface and a simulated grain into the side walls 14, 15 and 16 and the exterior end walls 18 and 19.

As seen in FIGS. 2 and 3B, a plurality of elongate elements 20, also typically eight in number and individually designated 20-1 . . . 20-8, are used to mount the module 10 and can be readily molded in the cavity of the module 10 along with subsequently-described exterior guides or other means for locating the elements and at least certain ones of interior walls. Each substantially identical element 20, of a series of eight individual elements, designated 20-1 . . . 20-8, is mounted in a corresponding compartment 11-1 . . . 11-8, and is comprised of a hub 33, FIG. 4. The hubs 33 may be of cylindrical cross section and have a series of central, open ended bores 32, individually designated 32-1 . . . 32-8, as shown in FIGS. 2 and 3B, which extend at least partially therethrough. The hubs 33 are illustrated as having square cross sectional shapes, but may have rectangular, circular, or other shapes in cross section. The longitudinal axis of each bore 32-1 . . . 32-8 is oriented perpendicular to the plane of the side wall 16 and the diameter of each bore is slightly greater than the fastener F, as shown in FIGS. 5 and 9, inserted therein during installation.

Figure 4:
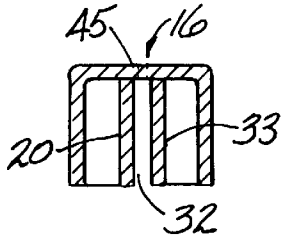
FIG. 4 is a sectional view along section lines 4—4 of FIG. 3B illustrating an embodiment of the module with a non-through bore.

In accordance with the embodiment of the invention illustrated in FIG. 4, each bore 32-1 . . . 32-8 has an axial depth which extends into the interior of the wall 16 a distance approximately nine-tenths the cross-sectional thickness of the wall 16. In such case, the bores 32 do not penetrate the side wall 16 completely and bottom out in the module. The presence of the series of mounting elements 20-1 . . . 20-8, as well as the locations of their respective mounting hubs 33 is concealed by the relatively thin or skin-like portions of wall 16 at the bottom ends of the bores 32-1 . . . 32-8. Such dead-ended bores are conveniently formed during the molding process by employing core pins that do not extend completely through the mold cavity that forms the wall 16.

Figure 6:
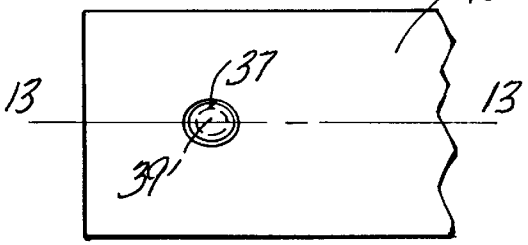
FIG. 6 is a plan view of a removable plug that may be used to cover an embodiment of the module with a through bore.

In accordance with another embodiment of this invention shown best in FIGS. 5, 6 and 8, the bores 32-1 . . . 32-8 are through bores with the longitudinal axes thereof likewise perpendicular to the plane of the top wall 16. These bores extend completely through the wall 16 and are of the same diameter as those of the previous embodiment. The internal wall of the upper end portion 36 of each bore 32 flares outwardly circumscribing an ellipse in plan view, FIG. 6, with the major axis parallel to the central axis 13 of the module 10. The opening of the end 36 is made elliptical in plan to closely simulate the cross-sectional appearance of the outer ring of a knot of wood cut flush with the module surface. Insertable into each end portion 36, with an interference fit, is a plug cap 37 typically composed of the same polymeric material as the module, and having inwardly inclined elliptical peripheral edge surface sized and shaped to fit flush against the inclined surface of the end portion 36. The top surface of the plug 37, FIG. 6, is flat in cross section and elliptical in plan so as to lie flush with the surrounding surface 16 of the module when the plug is seated in the bore. Typically, the plug is driven into its corresponding bore and remains in place by frictional engagement therewith. The top surface of the plug 37, FIG. 6, may be molded with a plurality of concentric elliptical lines 39 to simulate the growth rings of a knot of wood.

As shown in FIGS. 5 and 9, the plug 37 may cover each bore 32-1 . . . 32-8 including those containing fasteners, F. In the latter case, FIG. 5, a fastener F may be countersunk below the end portion 36 and the plug seated on top of the fastener flush with the top surface 16 and driven down into the bore with a mallet or a hammer. Accordingly, following installation, the presence of the bores, with or without fasteners therein, may be concealed by the plugs 37, which simulate the knots of a wood timber.

As seen in FIGS. 1 and 3B, the longitudinal axis of the bores 32 intersect the central axis 13 so that a longitudinally extending plane containing the longitudinal axes of all the bores 32 intersect the central axis 13. Conveniently, the plane containing the longitudinal axis of all bores 32 is spaced from each side wall 14 and 15 an equal distance which is one-half the width W of the module. The spacing between the end walls 18 and 19 and the respective end-most bores 32-1 and 32-8 in the mounting elements 20-1 and 20-8 respectively, is conveniently W/2 so that the stacking of an identical module 10-1 on the module 10, whether it be in parallel relationship or at some acute angle such as 90 degrees, results in vertical bore hole co-alignment. With a dimension of W/2, the bores 32-1 . . . 32-8 will be equally spaced along the axis 13 and from side walls 14 and 15 respectively, to provide maximum stack stability, as illustrated in FIG. 9.

As seen in FIGS. 2 and 3B, in each mounting compartment 11-1 . . . 11-8 the corresponding mounting elements 20-1 . . . 20-8 are located with their respective bores 32-1 . . . 32-8 in predetermined positions from each end wall and stabilized by pairs of struts 40, 41, FIG. 2, molded integral with the side walls 14, 15 and 16 and the hubs 33 of the mounting elements. The struts 40 and 41 intersect and extend from the elements 20 at 45-degree angles with respect to the central axis 13. The struts 40 and 41 are of rectangular cross-section and of equal length and zig-zag the length of the open side 12. In accordance with the specific illustrated embodiment, adjacent the location where the struts 40, 41 extending from each of elements join opposite side walls 14 and 15 are eleven interior end walls 22 individually 22-1 . . . 22-11. The end walls 22 are of rectangular shape and are integral with the side walls 14 and 15. The end walls with intermediate portions of the side walls form eight individual and substantially identical box-like compartments 11-1 . . . 11-8 of a W width and substantially W in length. Each mounting element 20 is thereby mounted substantially centrally in a corresponding compartment 11 having solid interior end walls similar to the exterior walls 18 and 19 in shape and overall appearance from the face end thereof and molded integral therewith.

Figure 10:
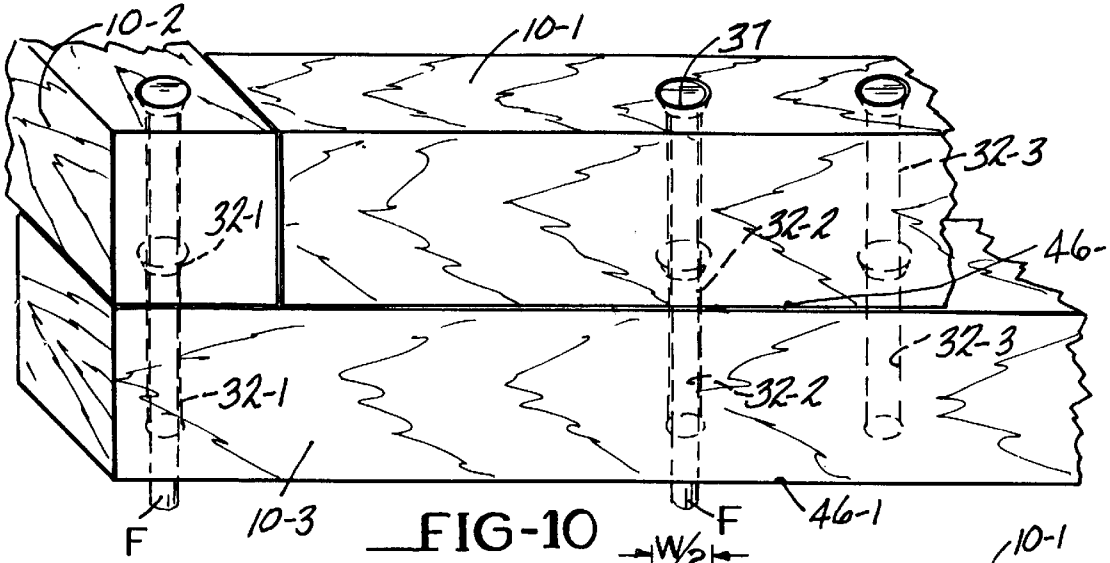
FIG. 10 is a front view illustrating another possible embodiment of a multi-layered retaining wall utilizing combinations of modules of various lengths and orientations.
Figure 11:
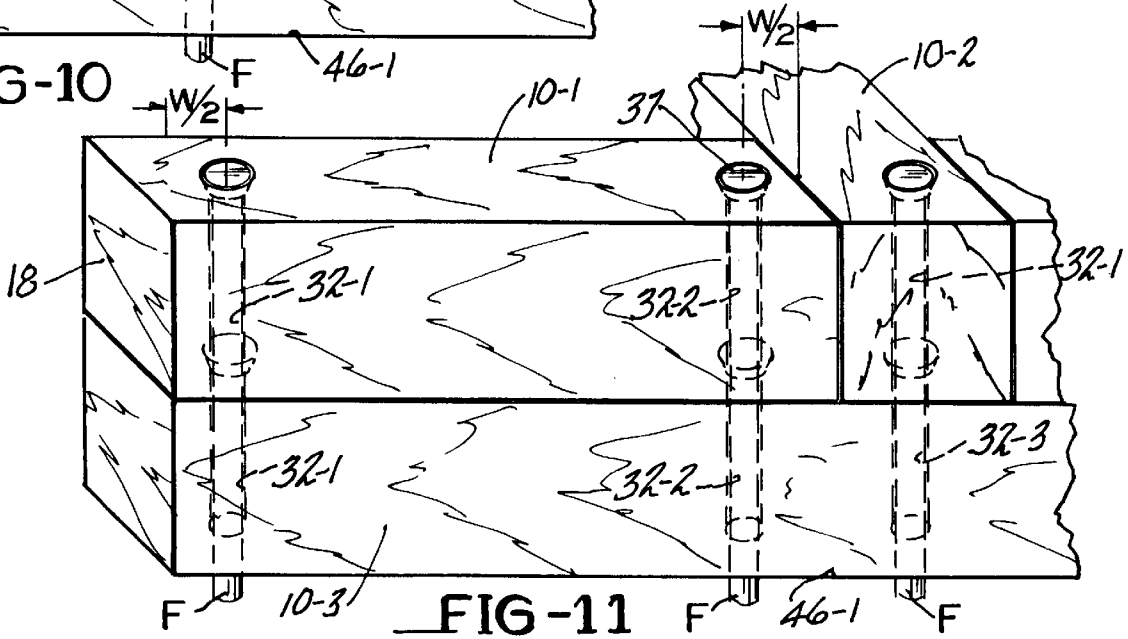
FIG. 11 is an isometric front elevation view illustrating an embodiment of another installation of modules.

The interior walls 22-1 . . . 22-11 join the side walls 14 and 15 and lie in planes parallel to the planes of the exterior walls 18 and 19 and each of the interior walls may serve as an alternate to an exterior end wall for applications requiring the installer to shorten the module 10 by cutting off a portion of the length of the module close to or through a selected one of the interior walls 22-1 . . . 22-11. The interior end walls 22 are typically solid throughout and similar in appearance to a removed wall 18 or 19 when the module 10 is severed parallel to the face of the end wall, that is, at substantially right angles to the axis 13 and flush with the face of the selected interior wall or through a vertical plane containing that wall. For those installations, such as shown in FIGS. 9, 10 and 11, where the end of the severed module abuts the side wall surface of another module and, therefore, may not be visible, the module need not necessarily be cut flush with an endmost interior wall 22-1 or 22-11 and the distances of all interior walls from an end wall 18 or 19, except for the three walls 22-3, 22-6, and 22-9, is not critical.

Referring to FIGS. 2, 3A and 3B, the surfaces of interior endmost end walls 22-1 and 22-11 directly opposite respective exterior end walls 18 and 19 of the module 10 are each positioned inwardly a distance which may be equal to or slightly less than W, as shown, taken parallel to the central axis 13 from the end walls 18 and 19, respectively. If equal, the surface of the walls will show after the W length is severed from the module.

As seen in FIGS. 1, 2, 3A and 3B the distance along the axis 13 of the each of the bores 32-1 and 32-8 from its adjacent respective flat exterior surface of end wall 18 and 19 is W/2. Thus, the stacking of two modules 10-2 and 10-3 at right angles to one another with the butt ends of the two modules 10-2 and 10-3 respectively flush with one another, as illustrated in FIGS. 9–11, will result in bore hole co-alignment between the bores 32-1 of module 10-2 and its corresponding endmost bore 32-1 or 32-8 in the second module 10-3, depending on which end 18 or 19 of the module 10 the second module 10-2 is placed. Accordingly, the installer can drive a rebar fastener, designated F, in through the co-aligned bores of both modules 10-2 and 10-3 to form a flush right angle corner to the stack. The same bores will be co-aligned when two modules of length L are placed on top of one another with their butt ends flush, FIG. 10.

A typical module 10, as shown in FIGS. 3B and 5, constructed in accordance with this invention has a width W of approximately 5.5 inches and a length of 96 inches. The vertical midpoints of the interior walls designated 22-3, 22-6 and 22-9 are spaced at 24, 54 and 72 inches respectively, from the end wall 18 along the central axis 13 and are of twice the thickness of the other interior walls for reasons described hereinafter. The axis of the bore designated 32-1 at the exterior wall 18 is spaced substantially 2.75 inches from the exterior surface of the wall 18 and its adjacent interior end wall, designated 22-1, is located approximately 5.5 inches from the wall 18. Similarly, at the opposite end wall 19, the mounting element 20-8 is spaced 2.75 inches from the butt end of wall 19 and the planer outermost surface of its adjacent interior wall 22-11 is substantially 5.5 inches from the butt end of wall 19. Spaced at 6.5 inches from each side of a vertical plane through the interior wall 22-3 are a pair of associated interior walls 22-2 and 22-4, and corresponding bores 32-2 and 32-4 are located at 2.75 inches from the wall 22-3. Likewise, the middle interior wall 22-6 has opposite interior walls 22-5 and 22-7 are at 5.5 inches and bores 32-5 and 32-7 are at 2.75 inches from each side of the wall 22-6. Similarly, wall 22-9 has opposite interior walls 22-8 and 2210 at 5.5 inches and bores 32-6 and 32-7 at 2.75 inches from the midpoint of the wall 22-9.

Figure 12:
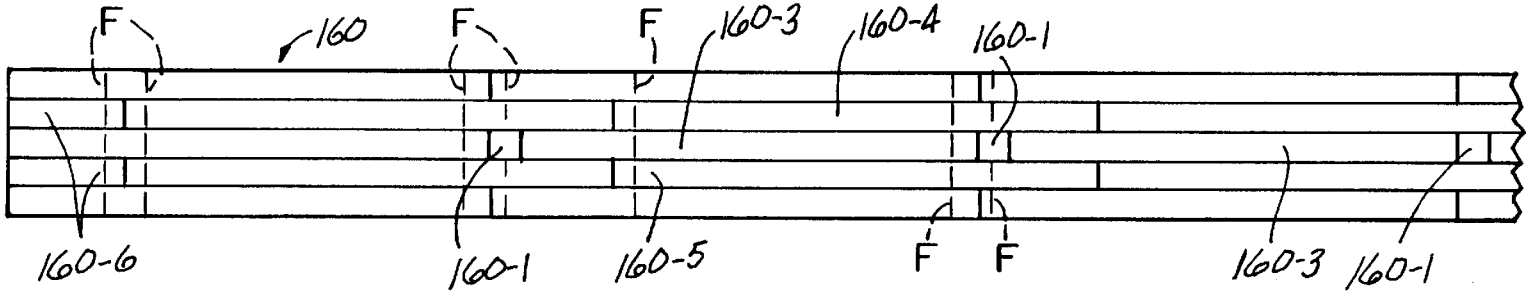
FIG. 12 is an isometric front elevation view illustrating an embodiment of another installation.

In accordance with the foregoing example, and as shown in FIG. 3B, the vertical planes passing through the mid-thicknesses of the interior walls 22-3, 22-6 and 22-9 are respectively located at 2,4 and 6 feet from the planar end 18 of the module 10 and, because of their double thickness compared to the end walls 18 and 19, walls 22-3, 22-6, and 22-9 are conveniently used as alternative exterior end walls when the module is transversely or vertically severed at two-foot lengths by the installer to shorten the length of the module for staggering or for the production of a dead-man, as shown in FIGS. 11 and 12. In the specific example, the end walls 18 and 19 have a thickness of 10 mm, and the interior walls 22-3, 22-6 and 22-9 have a thickness of 20 mm. The thickness of walls 22-3, 22-6 and 22-9 may also be about twice that of corresponding pairs of the interior walls on either side of walls 22-3, 22-6 and 22-9, which pairs are typically not needed to provide alternative solid end walls for typical installation applications requiring module severing of 2, 4, and 6 foot segments. If greater strength and resistance to flexure is desired of the module 10, or if the user applications required such, all interior end walls 22-1 . . . 22-11 could be of equal and greater than 10 mm in thickness, as will be apparent. Advantageously, by providing the walls 22-3, 22-6 and 22-9 with a thickness twice that of the other interior walls the installer may cut through the vertical plane which is midway between the opposite planer surface of the wall and parallel to the plane of the thicker wall and thereby produce two module segments, both with solid end walls at each end thereof and of substantially the same 10 mm thickness as an end wall 18 or 19. Obviously, the vertical cut may be made flush with the wall surface of a wall 22-3, 22-6 or 22-9 so that the severed end of the module has an exterior wall of double thickness for added strength if the particular application requires such.

As seen in FIG. 9, when the module 10-1 abuts the module 10-2, the bore 32-1 will overlie the bore 32-1 of the module 10-3 because the module 10-1 will be displaced a distance of about 5.5 inches from the end of the module 10-3. If it is desired to have the bore holes of modules 10-1 and 10-3 in vertical alignment, a section of length equal to the width of module 10-2 is cut from the end of module 10-1. The shortened module 10-1 may be shifted, to the left as viewed in FIG. 10, to abut the side wall of the deadman 10-2, thereby restoring vertical alignment of all of the bore holes 32-1 . . . 32-8. Depending upon the design of the module, if the surface of the interior wall 22-1 facing outwardly is 5.5 inches from the end wall, the interior wall will provide a solid surface to the end of the shortened module.

In FIG. 11 the left corner of the stack is comprised of a two-foot section 10-1 overlying an eight-foot length 10-3.

The endmost wall of the module 10-1 is one of the severed interior walls 22-3, 22-6 or 22-9 of half thickness. As seen in FIG. 12, a typical multi-layered retaining wall 60 with a plurality of deadman modules 160-1 may be readily constructed by severing the module at 2, 4 and 6 foot lengths vertically through solid portions of the interior walls 22-3, 22-6 and 22-9 respectively, as shown in FIG. 2. This provides a solid end wall on each end of the severed, shortened modules of the same thickness as an end wall 18 or 19. Thus, four two-foot long modules or two four-foot long modules, with solid opposite ends may be cut from one eight-foot module 10 and placed in the wall 60 as deadman modules 160-1. The modules 106-6 are modules 10, of full or shortened lengths, connected to adjacent modules as shown in FIG. 11. Since, in accordance with the foregoing example, the deadman 160-1 has a width of approximately 5.5 inches, by cutting substantially 5.5 inches off the end 18 or 19 of the modules 160-3, which are placed against a deadman 160-1, vertical bore hole alignment between corresponding bores of overlying modules 160-4 and underlying modules 160-5 will be substantially restored as shown in FIG. 10.

Other two two-foot module segments similar to the module 10-1 shown in FIG. 11 may be placed at various locations in the wall 160, as necessary to achieve deadman deployment and horizontal module staggering, as will be apparent.

Because the open side of the module is typically covered by the side walls 14, 15 and the top wall 16, FIG. 9, after the modules 10 and 10-1 are laid in a vertical stack the location of the mounting elements and the points of entry into their bores are enclosed and hence must be ascertained by the installer from the module exterior. This is achieved by molding unobtrusive bore hole and/or interior wall locating indicia into the side wall.

For the case of non-through bore holes FIG. 4, there is provided small and unobtrusive asterisks or dimples 45 of about one-half inch in diameter on the exterior surface of wall 16 directly over and hence in vertical alignment with their corresponding bore holes 32. Alternatively or additionally, and as shown in FIG. 3A the indicia may be made on the rearward side wall 15 as a plurality of thin vertical lines 39-1, 39-2 and 39-3 molded or inscribed into the module 10 perpendicular to the axis 13 and vertically aligned opposite the vertical midplanes of the thicker interior walls 22-3, 22-6 and 22-9 and also possibly opposite a certain one or all of the other thinner interior end walls flush with a face of such walls (not shown). Locations of concealed bore holes may be determined by measuring from the indicia, as will be evident. The linear indicia 39-1 . . . 39-3 also serve as cutting vertical guide lines which the installer may use to make cuts parallel to the outermost faces of the interior end walls. Such guides may be molded with the module during manufacture or inscribed by a sharp blade after the module is removed from the mold.

As seen in FIGS. 3A and 8 the modules also may be provided with laterally aligned semi-circular semi-circular openings or passageways 46-1, 46-2, 46-3, typically located substantially vertically opposite the vertical plane parallel to one of the surfaces of the interior walls 22-3, 22-6 and 22-9, respectively. The openings may serve as bottom cutting guides for the installer as well as open passageways for the egress of water through the module stack. The openings are formed as transversely aligned pairs of semi-circular open-sided grooves in the bottom edges of the side walls 14 and 15. Each groove pair extends perpendicular to the axis 13 and each groove is typically about three-eighths of an inch in diameter.

Figure 7:
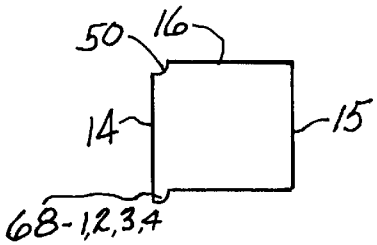
FIG. 7 is an end view of the module of FIG. 1 as viewed from the right side thereof showing an overhang for facilitating alignment of superimposed modules.

The module 10 may be designed to inhibit relative lateral displacement of the modules 10 and 10-1 when stacked on top of one another to form a retaining wall. As illustrated in FIGS. 3A and 7, the side wall 16 is provided with a longitudinal channel 50 formed in the normally rearward located juncture of the side walls 14 and 16. The channel 50 forms an open-sided rearwardly facing edge surface designed to mate with an outwardly projecting series of four, spaced-apart overhanging shoulders 68-1, 68-2, 68-3 and 68-4, respectively, formed on an opposite edge of side wall 15 in substantial vertical alignment with the channel 50.

The spacing between the pairs of adjacent shoulders slightly exceeds the length of each compartment 11 so that when modules 10 and 10-1 are stacked in overlying relationship, the shoulders 68-1 . . . 68-4 of module 10-1 fit into the channel 50 of the module 10 and abut the surface of the channel to inhibit outward lateral displacement of the module 10-1 relative to the module 10 lying thereunder and to facilitate parallel alignment of superimposed modules. The channel 50 also serves as a longitudinal opening for the stack when the modules 10 and 10-1 are placed at acute right angles to form the end corner of the stack.

When two modules are to be placed at acute angles and the upper module is to rest flush against the lower module, as best shown in FIGS. 9, 10 and 11, those surfaces of the upper module defining the mounting element compartments 11 on the underside of the module should be co-planar and devoid of projections which might tilt and unbalance the upper module. For this reason the spacing between the shoulders 68-1 . . . 68-4 are positioned to be directly opposite their corresponding compartments 11 in a direction perpendicular to the axis 13 to ensure that all edge surfaces defining the compartments of a module that may be placed upon an underlying module are flat and coplanar.

As can be appreciated from the foregoing description, modifications to the modules and structure may be made without departing from the scope of the appended claims.

We claim:

1. A modular structure for retaining walls and the like, comprising:

a preformed, elongated module comprised of a polymeric material and having a central longitudinal module axis extending the length of said module substantially centrally thereof, said module comprised of first, second and third elongated and substantially parallel side walls of substantially equal length, the first and third side walls positioned laterally opposite one another and the second side wall joining said first and third side walls in parallel, laterally spaced apart relationship, whereby the lateral dimension of the module perpendicular to said central axis is substantially constant;

a pair of exterior end walls formed integral with said side walls of substantially rectangular cross-section, said end walls lying in substantially parallel planes perpendicular to said central module axis, whereby the modular structure is substantially rigid and formed with a substantially U-shaped cross-section with the open side thereof opposite said second side wall;

a plurality of elongated module mounting elements mounted in the cavity defined by the U-shaped cross-section, each having a longitudinal major axis disposed perpendicularly to the plane of said second side wall, said elements facing the open side of the structure and positioned adjacent opposite respective exterior end walls of said structure, each of said mounting elements spaced laterally from an adjacent first side wall a first predetermined distance substantially equal to one-half the lateral dimension, each of said mounting elements formed with an open-ended bore aligned with the longitudinal axis of a corresponding mounting element for receiving structure staking means inserted into said bore, at least one of said elements spaced at the first predetermined distance from one of said exterior walls in a direction parallel to said central module axis, and at least one interior wall in said cavity located a second predetermined distance from one exterior end wall, which is substantially equal to said lateral dimension, said one interior wall having a planar surface lying in a plane substantially parallel to a plane containing a surface of said one exterior end wall, whereby said one interior wall may serve as an alternative exterior end wall to said structure in the event a length of the structure extending from said one interior wall is severed from the structure substantially parallel to the plane of said one interior wall.

2. The modular structure according to claim 1 and further comprising; a second planer interior wall of rectangular cross section in said cavity and lying in a plane between and substantially parallel to the planes of said exterior end walls, said second interior wall located between another pair of mounting elements and constructed to serve as an alternative to said exterior end wall in the event a length of the structure extending endwise from said second interior wall is removed from the structure.

3. The structure according the claim 1, and wherein said one interior wall is of greater thickness than one of said exterior walls.

4. The structure according to claim 3 wherein said one interior wall is substantially twice the thickness of an exterior wall, and wherein the module may be severed along a plane substantially midway between opposite surfaces of said one interior wall to provide a solid surface to each severed module.

5. The structure according to claim 1 and further comprising:

a plurality of planer interior walls located between said exterior end walls and formed integral therewith, said interior walls lying in planes substantially parallel to one another and to the planes of said exterior end walls, and said mounting elements located between different pairs of said walls.

6. The structure according to claim 5, wherein each of said mounting elements is comprised of a rigid, elongated hub with said bore having an open end and extending at least partially therethrough, the axis of each bore being concentric with said major axis of its corresponding mounting element and extending substantially perpendicular to the plane of said second side wall.

7. The structure according to claim 6, and further comprising; a plurality of rigid supports of rectangular cross-section intersecting each one of said hubs and extending at acute angles with respect to said central module axis to said hubs to join opposite respective interior surfaces of said first and third side walls.

8. The structure according to claim 7 wherein said supports extended in a zig-zag manner throughout the length of said cavity alternately abutting said first and third side walls.

9. The structure according to claim 8 wherein the open end of each said bores facing said open side of said module is substantially flush with an adjacent side wall.

10. The structure according to claim 1 further comprising:

a plurality of elongated, spaced-apart outwardly projecting shoulders formed on said module adjacent to the corner formed by the adjoining second and third side walls and extending parallel to said central module axis for engaging portions of a surface of another similarly constructed modular structure, thereby restraining movement of said module structure in a direction transverse to said central module axis and facilitating module alignment.

11. The structure according to claim 8 further comprising:

a plurality of elongated, spaced-apart, outwardly-projecting shoulders formed on said module adjacent to the corner formed by the adjoining second and third side walls and extending parallel to said central module axis for engaging portions of a surface of another similarly constructed modular structure, thereby restraining movement of said module structure in a direction transverse to said central module axis.

12. The structure according to claim 10 further comprising:

an inwardly extending, elongated recessed channel extending parallel to and formed in the module corner joining said second and first side walls for matingly engaging the shoulder of another similarly constructed modular structure.

13. The structure according to claim 12 wherein the exterior surfaces of said second side wall provides flat surfaces of the structure upon which a similar modular structure may be placed, and further wherein said shoulders are spaced apart in module areas including mounting elements and its corresponding opposite end walls.

14. The structure according to claim 1 which further comprises:

a plurality of removable plugs insertable into said second side wall at locations overlying different ones of said mounting elements for covering the underlying bores.

15. The structure according to claim 14 wherein said bores extend completely through said module and have elliptically-shaped side walls connecting with said second side wall, and wherein each of said plugs has an elliptical edge for seating in one of said bores with an exterior surface thereof flush with said second side wall.

16. The structure according to claim 14 which further comprises a plurality of position location indicia formed on one of said side walls at locations substantially laterally opposite at least one of said interior walls.

17. The structure according to claim 1 and further comprising at least one opening extending laterally through said first and third side walls for venting the module.

18. The structure according to claim 17 wherein said opening is substantially aligned with one of said interior walls to facilitate the location of said one wall.

19. The structure according to claim 16 wherein said indicia comprise linear indicia in said side wall in alignment with said one interior wall for providing a linear cutting guide for the installer.

20. A plastic timber-like structure comprising:

an elongated module molded from polymeric material as a major constituent and comprised of three side walls of rectangular cross-sectional shapes joined so as to form an open-sided structure of substantially U-shaped cross section with a pair of opposite side walls, an elongated interior cavity, and a longitudinal axis;

a plurality of mounting members mounted in said cavity, each member formed with an open-ended bore with the open end thereof facing the open side of the structure, the opposite end of said bore being covered, said members receiving structure supporting stakes inserted into their corresponding bores from the opposite end of said bores and through said one of the side walls overlaying said opposite ends of said bores;

a pair of said members located adjacent opposite respective ends of said cavity;

an interior wall of overall rectangular shape with substantially flat opposite end faces and extending transversely between said opposite side walls, with said end faces thereof lying in a plane which is substantially perpendicular to said longitudinal axis;

a second pair of mounting members in said cavity, each of said members located adjacent an opposite end face of said interior wall, said interior wall serving as an exterior end wall for said structure upon removal of a length of said module extending from either one of the end faces thereof; and means on at least one of said side walls for determining the location of said interior wall exteriorly of said structure.

21. An artificial timber-like structure comprising:

a rigid body of substantially parallelepiped shape molded of plastic material and having a longitudinal axis, a pair of substantially planar, exterior end wall portions at each end of said body;

at least one elongated mounting element in said body and having an wall defining a bore having a central axis perpendicular to said longitudinal axis for receiving a fastening means inserted into said bore at substantially right angles to said body;

a third substantially planar wall portion in said body with the plane thereof substantially parallel to and between the planes of said end wall portions, whereby said third wall portion may comprise an alternative wall portion to an opposite one of said end wall portions in the event the latter end wall portion is severed from said body, and said mounting element being located between one of said end wall portions and said third wall portion.

22. The timber according to claim 21, and additionally comprising, an elongated passageway extending transversely through said body for permitting water to flow therethrough, said passageway lying in or adjacent to the plane containing said third wall portion.

23. A landscaping module structure comprising:

an elongated body molded of plastic material and having a longitudinal module structure axis and a U-shaped cross section with an exterior surface formed by three adjoining side walls, a pair of substantially planar exterior end walls at substantially right angles to said module axis, and on open side, at least one substantially planar interior wall formed within the body in substantially parallel alignment with, and positioned between said exterior end walls, said interior wall having a substantially planar surface portion opposite one of said exterior end walls and adjoining portions of said side walls forming a walled cavity therebetween communicating with the open side of said body, said elongated mounting element having a longitudinal bore therein and mounted substantially centrally in said cavity with the longitudinal axis thereof substantially perpendicular to said longitudinal axis of said body, said bore receiving a fastener means inserted into said body and said mounting element.

24. The structure according to claim 23, wherein said bore extends through said body as a through-bore with an open end adjacent the body exterior surface, and further comprising: a cap insertable into the open end of said bore substantially flush with the exterior surface of said body for covering said open end.

25. The structure according to claim 24 and further comprising: means on the exterior surface of said body for locating said interior wall and/or said mounting element when said open side is covered.

26. The structure according to claim 23 wherein the dimension of said body perpendicular to said module axis is substantially constant, and wherein the bore of said mounting element has a length substantially equal to said dimension and is located along said longitudinal axis a distance of substantially one-half of said dimension from one of the said end walls.

27. The structure according to claim 26, wherein there are a pair of mounting elements adjacent different end wall portions with respective bores thereof located at substantially the same said distance from a respective end wall.

28. The structure according to claim 27 wherein a third wall portion is spaced inwardly from said one end wall portion a distance substantially equal to said dimension.

29. The structure according to claim 28 wherein there are a pair of third walls, each of said third walls spaced substantially the same distance inwardly from a different one of said exterior end walls.

30. The structure according to claim 29 wherein each of said third walls has a thickness greater than that of an adjacent exterior end wall.

31. The structure according to claim 30 wherein the respective wall portions defining each said cavity are substantially equal in size, whereby the interior periphery of each said cavity is substantially square as viewed from said open side.

32. The structure according to claim 31 and further comprising, a plurality of body reinforcing members mounted within said module and extending longitudinally between said cavities.

33. The structure according to claim 32 wherein said reinforcing members include a pair of intersecting struts abutting opposite ones of said side walls.

34. The structure according to claim 33 and further comprising a third cavity and a third mounting element located between the end pair of cavities and said pair of reinforcing members.

35. The structure according to claim 34 and further including shoulder means on said exterior surface of the module for inhibiting transverse displacement of the module.

36. The structure according to claim 21, wherein portions of said interior wall defining said bore are elongated in a direction substantially parallel to said longitudinal axis.

37. The structure according to claim 21, wherein said third wall portion is thicker in cross-section than an exterior wall portion.

38. The structure according to claim 26, wherein said adjoining portions of said side walls and said interior wall are dimensioned to define a substantially square shaped walled cavity, and said mounting element is centrally disposed thereon.

* * * * *